US006455480B1

(12) United States Patent
Bunting

(10) Patent No.: US 6,455,480 B1
(45) Date of Patent: Sep. 24, 2002

(54) LIQUID CLEANING AGENT FOR BOAT HULLS OF COMPOSITE MATERIAL

(76) Inventor: Curtis Bunting, 2223 Durham St., Tampa, FL (US) 33605

( * ) Notice: Subject to any disclaimer, the term of this patent is extended or adjusted under 35 U.S.C. 154(b) by 0 days.

(21) Appl. No.: 09/852,315

(22) Filed: May 10, 2001

(51) Int. Cl.[7] ..... C11D 1/70; C11D 3/04; C11D 3/36; C11D 7/08

(52) U.S. Cl. ..... 510/189; 510/199; 510/241; 510/242; 510/243; 510/365; 510/467

(58) Field of Search ..... 510/189, 199, 510/241, 242, 243, 365, 467; 134/42

(56) References Cited

U.S. PATENT DOCUMENTS 3,969,258 A * 7/1976 Carandang et al.
5,135,610 A * 8/1992 Tytgat et al.

* cited by examiner

*Primary Examiner*—Gregory E. Webb

(57) ABSTRACT

A cleaner comprises an active etching ingredient, a surfactant, a rust inhibitor, and a dilutant.

11 Claims, No Drawings

LIQUID CLEANING AGENT FOR BOAT HULLS OF COMPOSITE MATERIAL

BACKGROUND OF THE INVENTION

1. Field of the Invention

The present invention relates to a liquid cleaning agent for boat hulls of composite material and more particularly pertains to cleaning composite boat hulls.

2. Description of the Prior Art

The use of liquid cleaning agents of known formulations is known in the prior art. More specifically, liquid cleaning agents of known formulations previously devised and utilized for the purpose of cleaning objects through various methods and compositions are known to consist basically of familiar, expected, and obvious formulations, notwithstanding the myriad of designs encompassed by the crowded prior art which has been developed for the fulfillment of countless objectives and requirements.

While these devices fulfill their respective, particular objectives and requirements, they do not describe a liquid cleaning agent for boat hulls of composite material that allows cleaning composite boat hulls.

In this respect, the liquid cleaning agent for boat hulls of composite material according to the present invention substantially departs from the conventional concepts and designs of the prior art, and in doing so provides a formula primarily developed for the purpose of cleaning composite boat hulls.

Therefore, it can be appreciated that there exists a continuing need for a new and improved liquid cleaning agent for boat hulls of composite material which can be used for cleaning composite boat hulls. In this regard, the present invention substantially fulfills this need.

SUMMARY OF THE INVENTION

In view of the known disadvantages inherent in the known types of liquid cleaning agents of known formulations now present in the prior art, the present invention provides an improved liquid cleaning agent for boat hulls of composite material. As such, the general purpose of the present invention, which will be described subsequently in greater detail, is to provide a new and improved liquid cleaning agent for boat hulls of composite material which has all the advantages of the prior art and none of the disadvantages.

To attain this, the present invention essentially comprises 25 percent active etching ingredient, including but not limited to phosphoric acid, 16.7 percent surfactant, including but not limited to nonylphenol, 8.3 percent rust inhibitor, including but not limited to Rodine™ 213, less than 1 percent colorant, including but not limited to a conventional commercially available food dye, and 50 percent dilutant, including but not limited to water. These percentages are measured by volume. The cleaning agent is adapted to be sprayed on a composite material boat hull in a ratio of one quart to about 160 square feet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved liquid cleaning agent for boat hulls of composite material which has all of the advantages of the prior art liquid cleaning agents of known formulations and none of the disadvantages.

It is another object of the present invention to provide a new and improved liquid cleaning agent for boat hulls of composite material which may be easily and efficiently manufactured and marketed.

It is a further object of the present invention to provide a new and improved liquid cleaning agent for boat hulls of composite material which is of durable and reliable constructions.

An even further object of the present invention is to provide a new and improved liquid cleaning agent for boat hulls of composite material which is susceptible of a low cost of manufacture with regard to both materials and labor, and which accordingly is then susceptible of low prices of sale to the consuming public, thereby making such liquid cleaning agent for boat hulls of composite material economically available to the buying public.

Even still another object of the present invention is to provide a liquid cleaning agent for boat hulls of composite material for cleaning composite boat hulls.

Lastly, it is an object of the present invention to provide a new and improved cleaner comprising an active etching ingredient, a surfactant, a rust inhibitor, and a dilutant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the descriptive matter in which there is illustrated preferred embodiments of the invention.

DESCRIPTION OF THE PREFERRED EMBODIMENT

The preferred embodiment of the new and improved liquid cleaning agent for boat hulls of composite material embodying the principles and concepts of the present invention will be described.

The present invention, the liquid cleaning agent for boat hulls of composite material, including but not limited to fiberglass and plexiglass, is comprised of a plurality of components. Such components in their broadest context include an active etching ingredient, a surfactant, a rust inhibitor, and a dilutant. Such components are individually configured and correlated with respect to each other so as to attain the desired objective.

An active etching ingredient, including but not limited to phosphoric acid, is 23 to 27 percent, preferably 25 percent, of the cleaning agent.

A surfactant, including but not limited to nonylphenol, is 14 to 18 percent, preferably 16.7 percent, of the cleaning agent.

A rust inhibitor, including but not limited to Rodine™ 213, is 7 to 9 percent, preferably 8.3 percent, of the cleaning agent.

Rodine™ is a trademark of Amchem Products of Ambler, Pa. Rodine™ 213 is comprised 50 percent of a complex substituted keto-amine (CAS # 143106-84-7) and 1 to 10 percent isopropyl alcohol (CAS # 67-83-0) and 1 to 10 percent propargyl alcohol (CAS # 107-19-7) and 0 to 3 percent hydrochloric acid (CAS # 7547-01-0).

A colorant, including but not limited to a conventional commercially available food dye, is less than 1 percent of the cleaning agent. The inclusion of a colorant is optional.

A dilutant, including but not limited to water, is 50 percent of the cleaning agent.

The percentages above are measured by volume. The cleaning agent is adapted to be sprayed on a composite material boat hull in a ratio of one quart to about 160 square feet.

As to the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of cleaning boat hulls of composite materials comprising the step of spraying a cleaning agent on a composite material boat hull, wherein the cleaning agent comprises, in combination:

phosphoric acid;

a surfactant; and a rust inhibitor; and a dilutant, wherein the cleaning agent is adapted to be sprayed on a composite material boat hull in a ratio of one quart to about 160 square feet.

2. The method as set forth in claim 1 wherein the phosphoric acid ingredient comprises between about 23 percent and 27 percent of the cleaner by volume.

3. The method as set forth in claim 1 wherein the surfactant is a nonylphenol.

4. The method as set forth in claim 3 wherein the surfactant comprises between about 14 percent and 18 percent of the cleaner by volume.

5. The method as set forth in claim 1 wherein the rust inhibitor is Rodine™ 213.

6. The method as set forth in claim 5 wherein the rust inhibitor comprises between about 7 percent and 9 percent of the cleaner by volume.

7. The method as set forth in claim 1 wherein the dilutant is water.

8. The method as set forth in claim 7 wherein the dilutant comprise between about 45 percent and 55 percent of the cleaner by volume.

9. The method as set forth in claim 1 and further including a colorant which is a conventional commercially available vegetable food dye.

10. The method as set forth in claim 9 wherein the colorant is less than 1 percent by volume of the cleaner.

11. A liquid cleaning agent for boat hulls of composite materials the cleaning agent comprising, in combination:

23 to 27 percent phosphoric acid;

14 to 18 percent of a nonylphenol;

7 to 9 percent Rodine™ 213; and 45 to 55 percent water, the percentages above being measured by volume, the cleaning agent adapted to be sprayed on a composite material boat.

* * * * *